United States Patent [19]

Airey

[11] Patent Number: 4,727,939

[45] Date of Patent: Mar. 1, 1988

[54] TOOL FOR CLOSING A PRODUCTION COLUMN IN A WELL

[75] Inventor: Peter J. Airey, Volaines, France

[73] Assignee: Schlumberger Technology Corporation, Houston, Tex.

[21] Appl. No.: 12,962

[22] Filed: Feb. 10, 1987

[51] Int. Cl.[4] ..... E21B 34/14

[52] U.S. Cl. ..... 166/332; 166/162; 166/386

[58] Field of Search ..... 166/332, 334, 373, 386, 166/73, 162, 166, 168, 250, 316

[56] References Cited

U.S. PATENT DOCUMENTS 4,583,592 4/1986 Gazda ..... 166/386

4,678,035 7/1987 Goldschild ..... 166/373

*Primary Examiner*—James A. Leppink

*Assistant Examiner*—Terry Lee Melius

*Attorney, Agent, or Firm*—K. G. W. Smith; E. R. Archambeau, Jr.; Mary M. Yawney

[57] ABSTRACT

The invention relates to a tool suitable for closing a production column (100) of a well when the tool is located in a connector of enlarged diameter (101). The tool is lowered on the end of a cable (76) and includes a tilting valve member (60) which is oblong in shape and which is oriented longitudinally to pass through the corresponding oblong orifice of a valve seat (69) fixed to the connector, and is then oriented transversely in order to co-operate with said seat in order to close the production column when a traction force (F) is applied to the cable (76).

13 Claims, 18 Drawing Figures

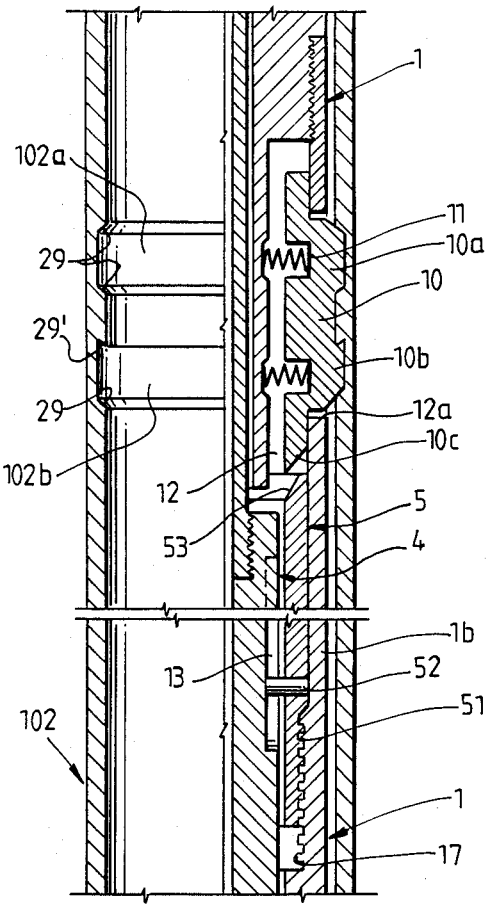
Fig. 3
Fig. 4
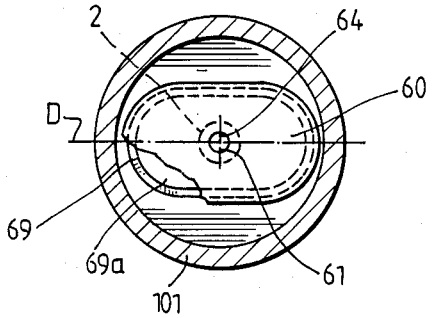
Fig. 5
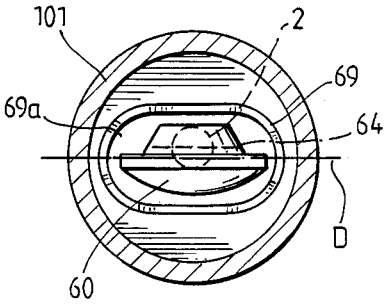

TOOL FOR CLOSING A PRODUCTION COLUMN IN A WELL

The present invention relates to a tool for closing a production column in a well containing fluid under pressure, such as oil, and designed to be lowered on the end of a suspension cable and to be temporarily fixed coaxially inside a sleeve of a tool connector incorporated in the production column, said connector being of greater diameter than the remainder of said column so as to enable fluid to pass easily around the tool when the production column is not closed.

BACKGROUND OF THE INVENTION

One of the more important tests for determining the production capacity of a hydrocarbon well consists in stopping production by means of a valve and in recording the pressure variations which result from the well being closed. It is advantageous to be able to close the production column in the immediate proximity of the underground production zone so as to eliminate certain disturbing effects due to the compressibility of the fluid present in the production column which effects appear when the well is closed at the surface.

The aim of the invention is to provide a closure tool which is simple in structure, which is capable of being installed in the production column of a well throughout the period that tests are performed on the well, and which can then be removed without difficulty.

SUMMARY OF THE INVENTION

A tool according to the invention includes a valve member for co-operating with a corresponding valve seat fixed across the inside of said connector, in order to close or to open the fluid-passing orifice therethrough; said orifice and said valve member being oblong in outline with the valve member being narrower than the width of said orifice; the valve member being orientable and capable of being positioned in a first orientation in which it extends longitudinally with the long axis of its outline being substantially parallel to the longitudinal axis of the tool, thereby enabling the valve member to pass through said orifice, and along a second orientation where it extends transversely thereby enabling it to co-operate with said valve seat after passing therethrough.

A closure tool presenting these dispositions can easily be put into place in a production column having a connector incorporated therein, with the connector including a seat corresponding to the valve member of the tool. The tool is lowered at the end of its suspension cable, with the valve member extending longitudinally in its first orientation. On reaching the valve seat, the valve member is capable of passing through the seat and then, after being set transversely in its second orientation, of operating normally in co-operation with said seat in order to close and to open the orifice therethrough, thereby closing or opening the production column.

In an advantageous embodiment, the tool comprises a first part which is generally cylindrical in shape having an outside diameter which is less than the diameter of the above-mentioned sleeve, said first part being suitable for being locked coaxially inside said sleeve, together with a second part capable of sliding coaxially inside the first part and including a rod which emerges therefrom at the end at which the valve member is mounted, said valve member being capable of tilting about a hinge axis perpendicular to the longitudinal axis of the rod, i.e. of the tool, and parallel to the short axis of the valve member outline.

In addition, in order to control tilting movements of the valve member in its first orientation or its second orientation, third part may be mounted to slide coaxially between the first part and the second part, said third part being in the form of a sleeve, and wherein a link extending in a plane passing through the general axis of the tool and perpendicular to the valve member hinge axis may be hinged at one end to the valve member and at its other end said third part in the region of the end thereof which projects from the first part so that when the second part slides out from the first part, the third part which is initially held in abutment against a shoulder on the second part accompanies the second part, thereby causing the link to place the valve member transversely in its second orientation, with the third part then being stopped by abutment means while the second part continues to move down without the third part, thus causing the link to tilt the valve member into its first orientation.

Preferably, the second part is constrained to rotate about the axis of the tool together with the first part, and wherein guide means are provided in the first part and on the connector sleeve such that when the tool reaches the connector as it moves down the production column, the first part is initially caused to pivot about the axis of the tool to take up an orientation in which the valve member hinge axis is parallel to the long axis of the orifice through the valve seat, with the first part being held in this orientation as the tool continues to descend over a distance which is greater than the length of the valve member, and finally to cause the first part to rotate through 90° about the tool axis so as to cause the valve member hinge axis to extend perpendicularly to the long axis of the orifice through the valve seat. These dispositions ensure that when the tool is put into place, the valve member is presented to the oblong orifice of the seat in a manner suitable for passing therethrough, and then for tilting to take up its operating position in which it co-operates with said seat.

Preferably, the guide means provided between the first part and the connector sleeve comprise a pair of tracks and a pair of studs, said studs engaging in said tracks as the tool moves downwardly through the connector sleeve, with each track comprising in succession: a flared first zone capable of receiving one of said studs regardless of the orientation of the tool on its arrival in the connector sleeve; a narrow rectilinear second zone extending parallel to the axis of the tool; and a similarly narrow third zone extending through 90° around said axis. The second zone ensures that the valve member passes through the seat and the third zone ensures that the valve member is put into the correct position facing said seat.

It is also advisable for the second part to be coupled to the fourth part which is capable of sliding longitudinally inside the first part and which emerges therefrom at the opposite end from the second part, i.e. the end where the suspension cable is directly or indirectly attached to the tool, such that when a traction force is applied to said cable, the fourth part moves against the force of a return spring, thereby retracting the second part into the first part and at the same time applying the valve member against its seat in a closure position.

In order to make it easy to open the production column after it has been closed and in spite of the high pressure of the fluid in the well tending to press the valve member firmly against its seat, it is advantageous for the tool to include a path for temporarily putting the portions of the production column which are situated on either side of the valve member into communication with each other prior to each occasion on which the valve member is opened. This disposition ensures that the pressures on either side of the valve member are equalized, thereby eliminating the pressure force which would otherwise prevent the valve member from moving away from its seat. This communication path is preferably constituted by at least one first radial orifice through the wall of the first part, a second radial orifice through the wall of the second part which faces the first orifice when the valve member is in its closure position against its seat, said second orifice opening out into an axial channel running along the second part which in turn opens out through the valve member when the valve member is in its closure position via a third orifice through the center of the valve member, and a fourth orifice extending radially through the wall of the fourth part which is coupled to the second part with a degree of axial play; the position of said fourth orifice on the fourth part being such that it comes into alignment with the first and second orifices during unloaded displacement corresponding to said play as performed by the fourth part when the fourth part is displaced towards the second part while the valve is closed with a view to causing the valve to open. Several groups of first, second and fourth orifices may be provided distributed around the general axis.

In an advantageous implementation, the axial channel through the second part extends to the opposite end of the tool from the valve via an axial channel through the fourth part, said two axial channels communicating with each other via a sealed sliding junction. Thus, a channel is established which passes along the entire length of the tool thereby allowing the pressure of the well to be transmitted, while the column is closed, to a measuring apparatus interposed between the tool and its suspension cable.

In order to hold the tool still in the connector in the position it is to take up, it is advisable for the first part to be provided with at least one locking member subjected to the action of at least one spring urging the locking member to emerge radially through the wall of the first part in order to be engaged in a peripheral recess provided in the inside surface of the connector sleeve. Preferably, the or each locking member comprises a bolt for engaging in a peripheral groove which constitutes said recess, and wherein the complementary top edges of the bolt and the groove directed towards the connection to the suspension cable are slightly undercut, thereby ensuring that the tool is locked against any traction force applied to its suspension cable.

BRIEF DESCRIPTION OF THE DRAWINGS

An embodiment of the invention is described by way of example with reference to the accompanying drawings, in which:

FIG. 4 is a cross-section on line IV—IV of FIG. 2C;

FIG. 5 is a view similar to FIG. 4, showing the tool valve member as it passes through its valve seat;

FIGS. 8A to 8E are longitudinal sections through the connector incorporated in the production column shown in five successive stages of the operations for putting the tool into place in the connector.

MORE DETAILED DESCRIPTION

Figure 1:
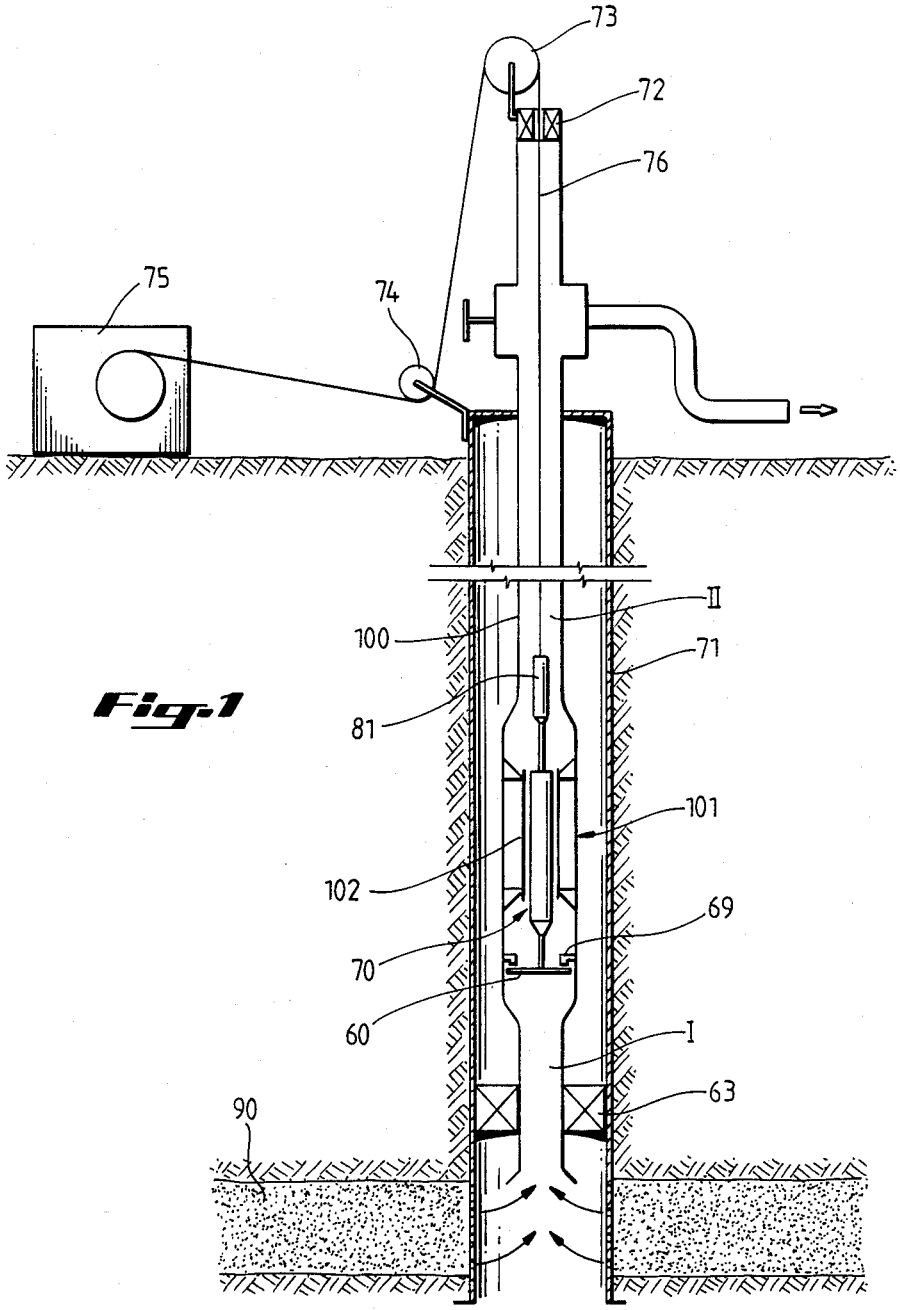
FIG. 1 is a diagrammatic vertical section through a well having a closure tool in accordance with the invention placed therein.

FIG. 1 shows a well drilled through an oil-producing zone 90 and comprising a production column 100 in casing 71. Between the bottom end of the production column 100 and the casing 71 there is an annular sealing device known as a "packer" 63. A closure tool 70 in accordance with the invention is suspended from the end of a cable 76 and is lowered into a specially prepared connector 101 which is incorporated in the production column 100 a little away above the production zone 90. The cable runs along the inside of the production column 100 and emerges from the top thereof via a sealing device 72 prior to passing over pulley wheels 73 and 74 and being wound onto the drum of a winch 75 located on the surface of the ground. The cable 76 is an electric cable which, in addition to providing the mechanical function of supporting and operating the tool 70, also provides the function of transmitting measurement signals to the surface from devices which may be associated with the tool, e.g. a pressure gauge 81 for measuring the pressure at the bottom of the well beneath the tool.

In the following description, the closure tool 70 is assumed to be in its normal operating position in a vertical well.

Figure 2A:
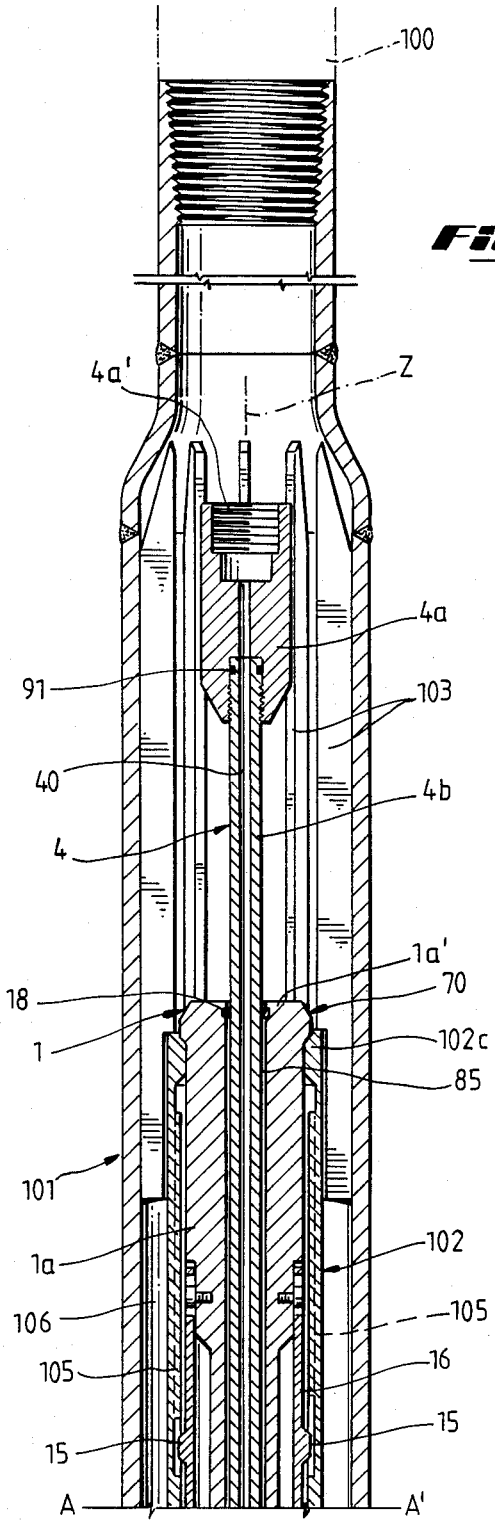
FIGS. 2A, 2B, and 2C are longitudinal sections through respective thirds of a tool in accordance with the invention, with said sections meeting one another along lines AA'and BB'.
Figure 2B:
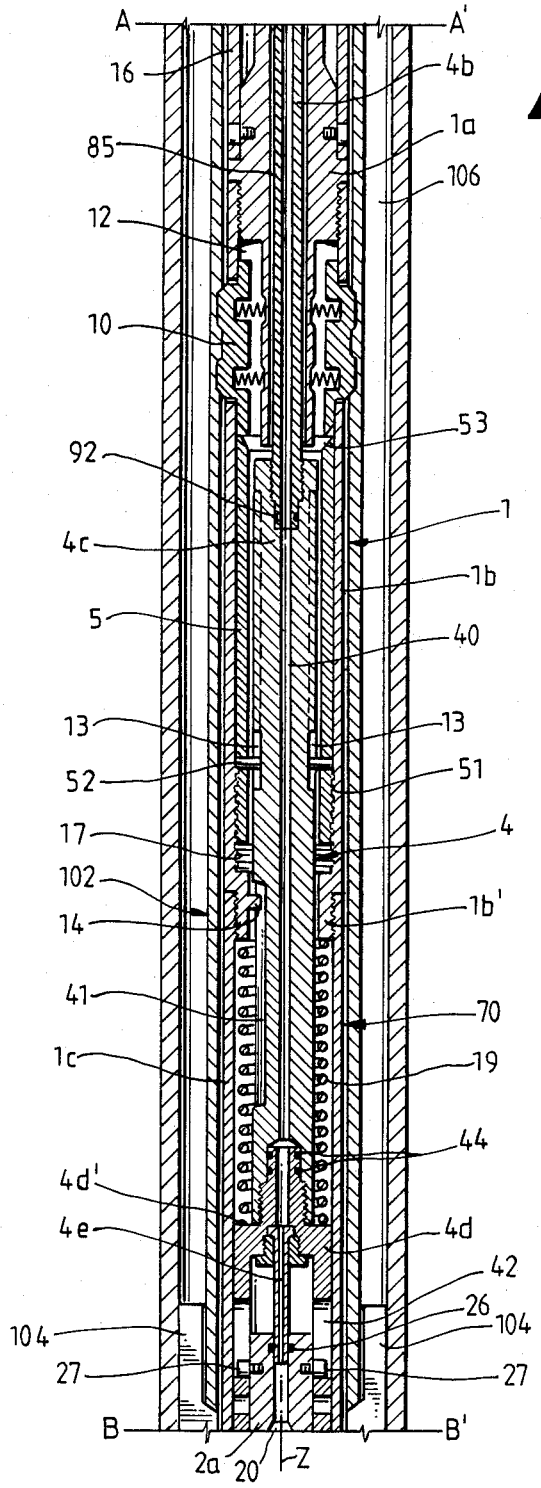
Figure 2C:
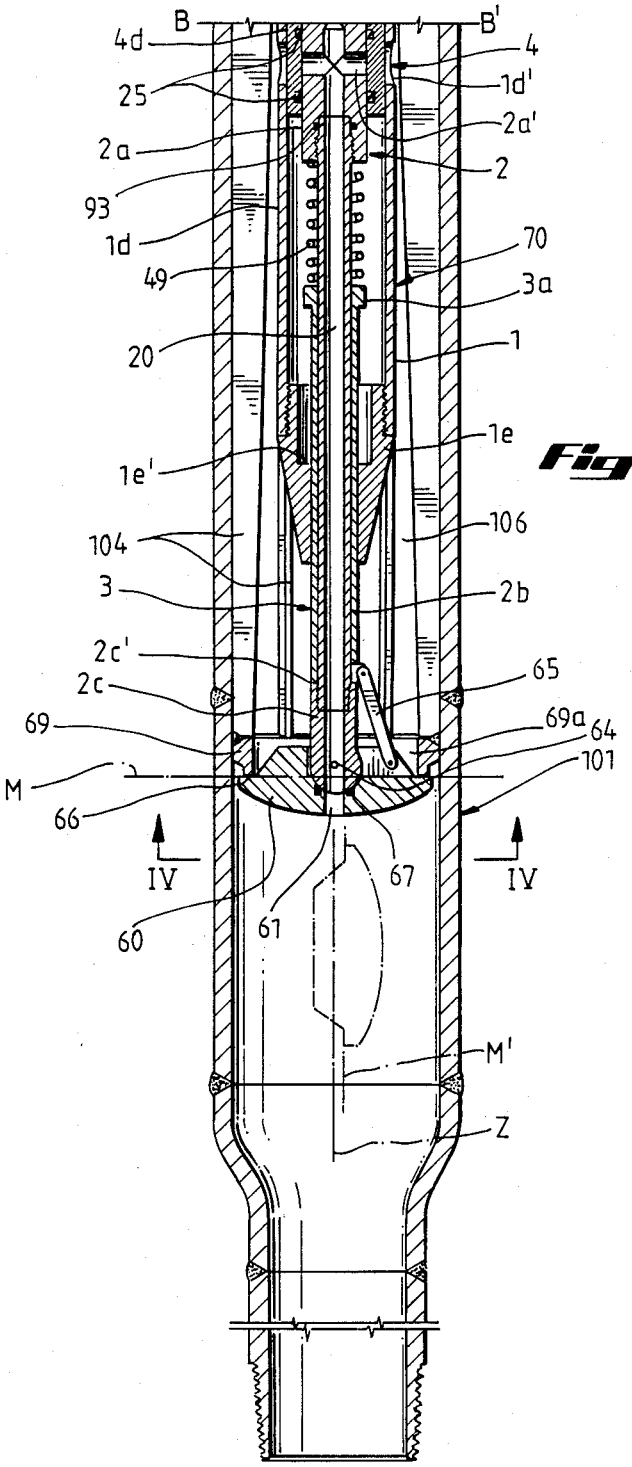

The tool 70 shown in FIGS. 2A, 2B, and 2C extends along a longitudinal axis Z and is essentially constituted by a long tubular part 1 which constitutes the outer envelope of the tool, a second part 2 capable of sliding longitudinally inside the part 1 and projecting from the bottom end thereof, a third sleeve-shaped part 3 capable of sliding between the part 2 and the bottom end of the part 1, a fourth part 4 which is disposed in alignment with the part 2, which is capable of sliding inside the part 1, and which it emerges from the top end of the part 1, and a relatively short sleeve-shaped part 5 which is disposed between the parts 1 and 4. The part 4 is built up from various elements screwed together end-to-end. The top element 4a has a tapped bore 4a'. enabling a pressure gauge 81 to be screwed therein with the pressure existing in the well beneath the tool 70 being conveyed to the pressure gauge via a channel 20, 40 extending axially along the entire length of the tool and opening out into the bore 4a'. The part 4 is capable of sliding longitudinally inside the part 1 which is arranged to fit with a small amount of play inside a sleeve 102 which is of slightly smaller diameter than the column 100 and which is fixed coaxially inside the connector 101 by means of radial fins 103 and 104 which are welded both to the inside wall of the connector 100 and also to the ends of the outer surface of the sleeve 102. The part 1 and the connector sleeve 102 include means enabling them to be locked together, i.e. means for locking the tool in the connector. An annular gap 106 is left between the sleeve 102 and the wall of the connector 101 since the connector is of larger diameter than the production column 100, thereby leaving a large passage bypassing the tool 70 for the flow of fluid which rises along the production column whenever the column is not closed.

The part 1 is locked in the sleeve 102 by members 10 which are disposed to move radially in cavities 12 provided in the part 1 and capable of projecting from the outer surface thereof via windows 12a under radial thrust from springs 11, thereby locking the part 1 in the sleeve 102 by engaging in a complementary-shaped recess provided in the wall of the sleeve. More precisely, each locking member 10 comprises two bolts 10a and 10b disposed one above the other, and said recess is constituted by two peripheral grooves 102a and 102b, each having a profile which is complementary to the profile of the corresponding bolt. This profile includes sloping edges 29 suitable for camming the bolts so that they can escape from the grooves when the part 1 moves along the sleeve 102, together with an oppositely sloping undercut top edge 29' for the bottom groove 102b for engaging in a correspondingly shaped top edge in the bottom bolts 10b, so as to prevent said bolts from moving upwardly once they have been engaged in the groove, thus preventing the part 1 from moving upwardly in the sleeve 102 when it is subjected to an upwardly directed traction force. The part 1 cannot move further down the sleeve 102 since it is stopped by an outwardly directed flange 1a' at the top of the pary 1 which rests on the top of the sleeve 102 (and in particular on an inwardly directed rim 102c of the sleeve), when the bolts 10a and 10b come opposite to the grooves 102a and 102b as the tool 70 is being inserted in the connector 101. As explained below, the tool 70 is not permanently locked in place by the bolts 10.

Beneath its top element 4a, the part 4 comprises a long small-diameter tube 4b capable of sliding in a cylindrical passage 85 which extends axially along an element 1a which constitutes the top portion of the part 1, with the element 1a ending just below the locking bolts 10. The bottom of the tube 4b is connected to a tubular part 4c which is of larger diameter and which includes a longitudinally extending groove 41 in the bottom portion thereof for receiving a peg 14 belonging to the part 1. This disposition enables the part 4 to slide in the direction of the axis Z inside the part 1, but prevents it from rotating relative thereto about said axis.

Beneath its top element 1a, having an outside diameter which, generally speaking, is slightly less than the inside diameter of the connector sleeve 102, the part 1 continues in the form of a thin-walled tubular element 1b having the same outside diameter as the element 1a. The windows 12a for passing the bolts 10 for locking the tool in the sleeve 102 pass through the wall of this tubular element 1b near its top.

The element 1b of the part 1 is connected to an element 1c which is also a thin-walled tubular structure and which has the same outside diameter.

An annular cylindrical gap is provided between the element 4c of the part 4 and the elements 1b and 1c of the part 1, with the top of the gap inside the element 1b being occupied by the sleeve 5 which is capable of longitudinal displacement and whose bottom portion, inside the element 1c, receives a compression spring 19 which bears firstly against the bottom end 1b' of the element 1b acting as an abutment rim inside the element 1c, and secondly against an abutment rim 4d' provided by the top of an element 4d which is connected to the element 4c and which is of larger diameter, having an outside diameter which is substantially equal to the inside diameter of the element 1c. The element 4d has a downwardly directed thinwalled cylindrical skirt which slidably receives the top portion 2a of the part 2, which part extends downwardly in the form of a thin-walled tubular element 2b of smaller diameter that extends downwardly beyond the bottom end of the part 1. The bottom end of the part 2 is constituted by an element 2c fixed to the element 2b and carries a valve member 60 suitable for co-operating with a valve seat 69 fixed to the connector 101. A sleeve 3 is disposed between the element 2b of the part 2 and the end element 1e of the part 1 and is capable of sliding in an easy fit relative to both of said elements 2b and 1e. A compression spring 49 mounted around the top portion of the element 2b in between the element 2a and a flange 3a provided at the top of the sleeve 3, urges the sleeve 3 is downwardly in abutment against the end element 2c of the part 2 which has a slightly larger diameter than the element 2b.

The channel 20, 40 passing along the tool 70 from end to end runs along the axis of the parts 2 and 4. The two parts are capable of sliding longitudinally relative to each other and the transition between them is provided by means of a sealed junction comprising a small tube 4e extending the channel 40, axially extending the element 4d, and engaged in the inlet to the channel 20 which is formed in the top element 2a of the part 2. At its bottom end, the channel 20 terminates in an orifice 61 passing through the center of the valve member 60, said orifice being aligned with the channel 20 when the valve member is in its closure position.

The valve member 60 is mounted at the bottom end of the part 2 in such a manner as to be able to pivot about a transverse axis 64, thereby enabling its average plane to take up an orientation which may be transverse (as shown in solid lines in FIG. 2C) or else longitudinal (as shown in dot-dashed lines in FIG. 2). Further, the valve member 60 and the orifice 69a are oblong in outline as can be seen in FIG. 4, and the sizes of these members are such that if the valve member 60 is tilted through 90° about the axis 64 away from its closure position in order to orient its plane in the longitudinal direction, and if it is also rotated through 90° about the longitudinal axis of the part 2 which supports it (i.e. about the general axis Z) in order to cause said plane to extend parallel to the direction D of the long axis of the orifice 69a through the seat 69, it is then possible, as shown in FIG. 5, to pass the valve member 60 through the seat orifice by imparting a movement in longitudinal translation to the part 2, since the thickness of the valve member is less than the width of the orifice through the seat. This feature makes it possible in a manner explained below for the valve member to be put into service at the same time as the tool 70 is installed in the connector 101, and it also allows the tool to be subsequently removed without the valve member opposing such removal.

Figure 6:
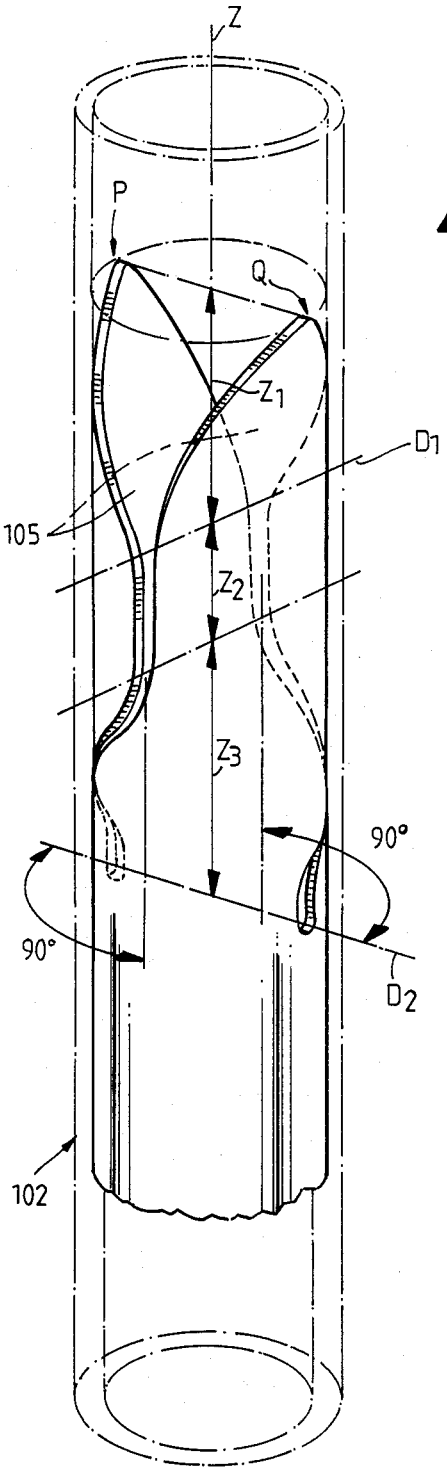
FIG. 6 shows a portion of the sleeve having guide paths hollowed out in its inside surface with the uninterrupted peripheral sleeve material being omitted from the drawing for reasons of clarity.

Rotation movements of the part 2 about the axis Z are obtained by causing the part 1 to rotate about said axis with the part 1 being coupled in rotation with the part 4 via the pegs 14 engaged in the grooves 41, and with the part 4 being coupled in rotation with the part 2 via pegs 27 on the part 2 engaged in longitudinal grooves 42 in the bottom element 4d of the part 4. The part 1 is rotated by means of a pair of outwardly projecting studs 15 provided thereon which, when the tool is inserted into the connector sleeve 102, co-operate with a pair of guide paths 105 formed in the inside wall of said sleeve (see FIG. 6). When the tool comes into the connector 101 in which it is to be inserted, each of the studs 15 which extend in arbitrary directions about the axis Z at that moment engages a first portion of one of the guide paths 105 which extends over a longitudinal zone Z1 and is flared in shape so as to act as a funnel. The edges of each of the paths 105 begin at the top in respective points P and Q which are diametrically opposed about the axis Z; thereafter the edges move towards each other until they are separated at the bottom of the zone Z1 by no more than the width of the studs 15 they are to guide. The two paths 105 are then diametrically opposed along a direction D1 such that, when the studs 15 reach this location, the hinge axis 64 of the valve member 60 lies parallel to the direction D of the long axis of the orifice through the valve seat 69. In the following zone Z2, the two guide paths retain the same reduced stud-receiving width parallel to the axis Z over a length which is not less than the length of the valve member 60. This zone Z2 is followed by a zone Z3 in which the guide paths, still at reduced width, continue while curving through 90° around the axis Z so that at the bottom of the zone Z3 they are diametrically opposed along a direction D2 which is perpendicular to the initial direction D1. When the studs 15 are aligned in this direction D2, the hinge axis 64 of the valve member is parallel to the short axis of the orifice through the valve seat.

In order to allow the studs 15 to pass the inwardly-directed rim 102c at the top of the sleeve 102, the studs 15 are carried by resilient blades and voids are left behind the studs 15 in the body of the part 1. Thus, the studs 15 are automatically retracted as they move past the rim 102c after which they return to their normal extended position in order to engage the guide paths 105 of the sleeve 102.

The valve member 60 is tilted about its hinge axis 64 by means of a link 65 disposed in a radial plane and hinged at one end to the valve member 60 and at its opposite end to the bottom of the part 3. When the part 3 is in abutment against the element 2c of the part 2, as shown in FIG. 2C, the link 65 holds the valve member 60 so that its average plane M is perpendicular to the axis Z. As the element 2c moves away from the part 3, the link 65 tilts the valve member 60 about the axis 64 until its average plane is moved to M' where it is parallel with the axis Z.

Figure 9B:
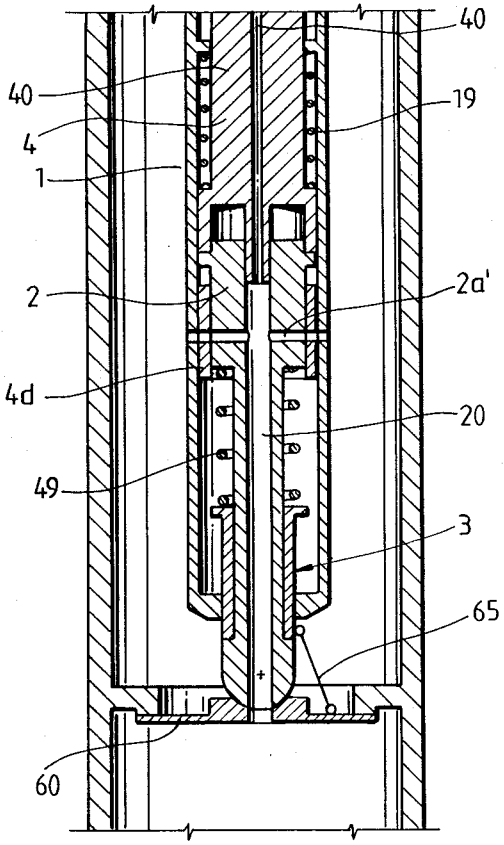
FIGS. 9A to 9D are simplified diagrammatic longitudinal sections showing the valve member and the associated portion of the tool when in place in the connector, and showing four successive stages in the displacement of the valve member from its closure position to its open position.
Figure 9A:
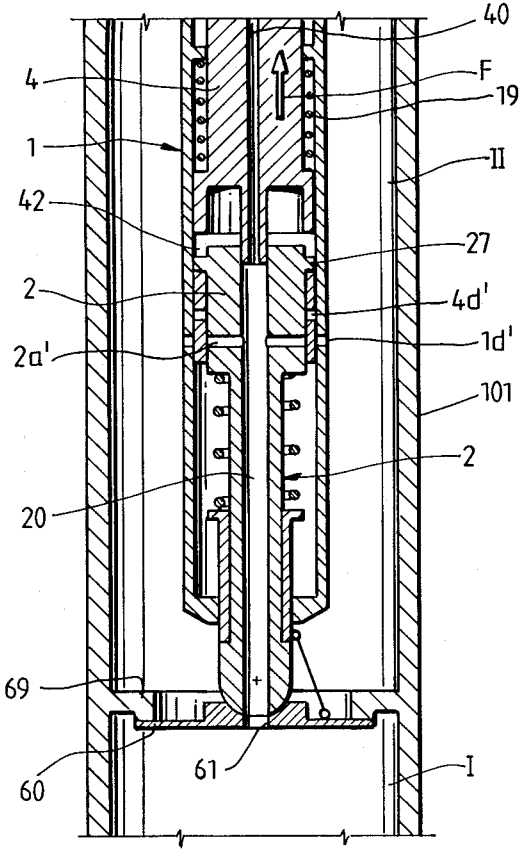
Figure 9D:
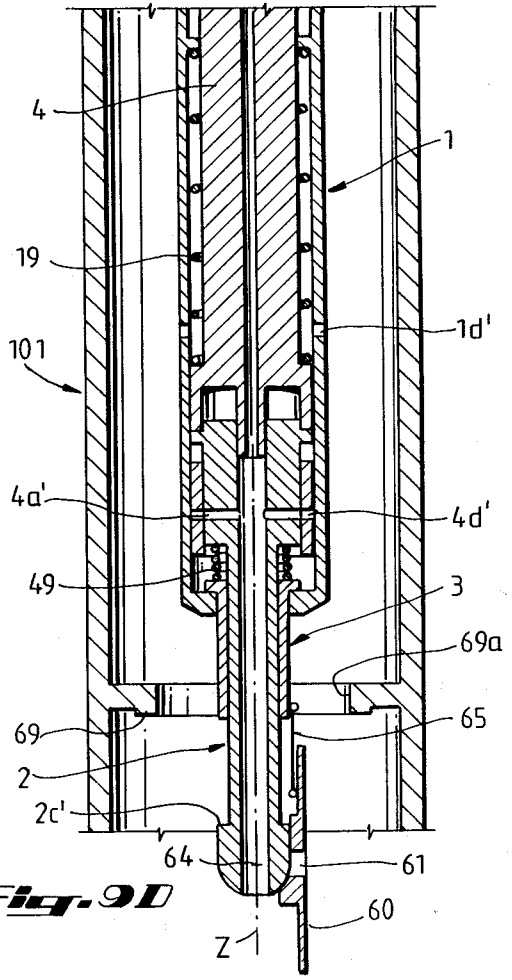
Figure 9C:
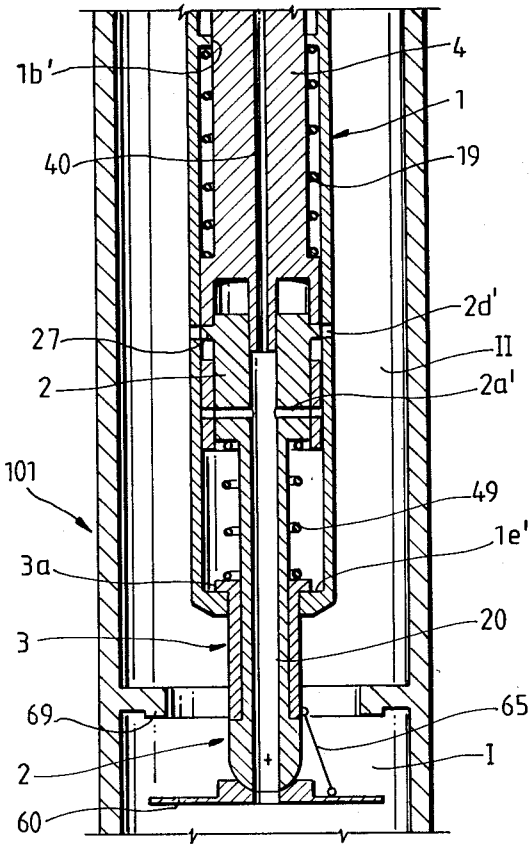

These various movements are illustrated in FIGS. 9B to 9D. When starting from the rest position (FIG. 9B), the part 2 moves downwardly (under the action of the spring 19 and the part 4), the part 3 begins by moving downwardly therewith since it is pressed against the abutment 2c' provided by the end element 2c of the part 2 by means of the spring 49. The valve member 60 also moves downwardly in simple translation away from its closure position. Then, the part 3 is stopped by its top flange 3a coming into abutment against the end 1e' of the part 1 in which it was sliding (FIG. 9C). The part 2 continues to move downwardly (thereby compressing the spring 49 which is weaker than the spring 19), the valve member 60 tilts about its hinge axis 64 (FIG. 9d) under the action of the link 65 since the point where the link is hinged to the part 3 is fixed, and the valve member ends up in its position of longitudinal orientation where its average plane is parallel to the general axis Z of the tool.

The operations of placing the tool 70 in position in the connector 101 are now described with reference to FIGS. 8A to 8E.

The tool is lowered down the production column 100 on the end of the cable 76 to which it is connected by the pressure gauge 71. Under the effect of the spring 19 expanding in the absence of a traction force applied to the cable 76, the valve member is tilted into its longitudinal position so that its plane is parallel to the axis Z. The tool enters the sleeve 102 of the connector 101 at an arbitrary orientation relative to the axis Z. The studs 15 of the part 1 engage in the flared first zone Z1 of the guide paths 105 in the sleeve 102 and cause the part 1 to pivot about the axis Z so that the valve member 60 is brought, by means of the parts 4 and 2, into a position where it lies parallel to the long axis of the oblong orifice 69a through the seat 69. With the tool continuing to be lowered under the action of gravity, the studs 15 run along the zone Z2 where they retain the same orientation so that the valve member 60 passes in a pure translation movement through the valve seat 69 (FIG. 8B). Then, the studs 15 reach the zone Z3, thereby pivoting the part 1 through 90° about the axis Z so as to bring the hinge axis 64 of the valve member 60 into a position where it is perpendicular to the long axis of the orifice 69a through the seat 69 (FIG. 8C). The part 1 is shaped so that the longitudinal distance between its studs 15 and its locking members 10 corresponds to the distance between the bottom of the guide paths 105 (bottom end of the zone Z3) and the grooves 102a and 102b in the sleeve 102 so that when the studs have completed their passage through the zone Z3, the bolts 10a and 10b are level with said grooves 102a and 102b and are engaged therein, thus locking the part 1 in the sleeve 102. The tool 70 has now been installed in the connector 101.

If a traction force F is now applied to the cable 76, the part 4 is raised, thereby compressing the spring 19, and thus raising the part 2 (initially on its own), thereby tilting the valve member 60 parallel to the plane of its seat 69 (FIG. 8D) under the action of the link 65, and then engaging the sleeve 3 by means of its shoulder 2c so that the valve member is moved upwardly in a movement of pure translation. When it reaches its seat (FIG. 8E), the valve member 60 closes the orifice 69a through the seat and thus closes the production column 100 itself, leaving the production column separated into two regions I and II which are isolated from each other by the member 60 while in its closure position. The pressure in the lower region I which is in communication with the hydrocarbonproducing layer 90 is nevertheless transmitted, for measurement purposes, to the pressure gauge 81 via the central orifice 61 through the valve member and the axial channel 20, 40 provided along the tool.

In this situation, shown diagrammatically in FIG. 9A, the valve member 60 is firmly pressed against its seat 69 by the very high pressure existing in the well, and a corresponding force opposes any opening of the valve member whenever it may be desired to put the regions 1 and 2 back in communication with each other.

In order to mitigate this difficulty, means are provided for equalizing the pressure in the regions I and II prior to opening the valve, as described below.

When the traction force F is released, the spring 19 begins to expand and the part 4 begins to move downwardly, on its own, by virtue of the slack which exists initially between the part 4 and the part 2, corresponding to the length of the slot 42 in which the pegs 27 are engaged. The element 4*d* (see FIG. 2B) at the bottom of the part 4 forms a cylindrical skirt around the part 2 and has radially directed orifices 4*d'* therethrough. After this downward movement of the part 4, and when it comes into contact with the part 2 by engaging the pegs 27 thereon, these orifices 4*d'* are aligned (see FIG. 9*b*) firstly with orifices 2*a'* extending radially through the top portion of the part 2 (in particular through its element 2*a*, see FIG. 2C), and in communication with the channel 20 which passes axially through said part, and secondly with orifices 1*d'* passing radially through the wall of the part 1 (and more precisely through the element 1d thereof, see FIG. 2C), at a height such that they are opposite the orifices 2*a'* when the part 2 takes up, its position corresponding to the valve 60 being closed (FIGS. 9A and 9B). At this moment, the regions I and II are put into communication with each other via the orifices 1*d'*, 4*d'*, 2*a'*, the channel 20, and the orifice 61 through the valve member when in its closure position. Pressures are thus equalized since the region II is closed at the surface.

Then, once pressures have equalized, the part 4 continues to move downwardly with the part 2, thereby lifting the valve member 60 away from its seat 69 (see FIG. 9C). The two regions I and II of the production column are now in full communication with each other.

The downward translation movement of the valve member continues until the part 3 which accompanies the part 2 in its downward movement under the action of the spring 49 is stopped by its flange 3*a* coming into abutment against the shoulder 1*e'* provided at the bottom end of the part 1. From then on, the part 2 continues to move down together with the part 4 (see FIG. 9D) but without the part 3, and the link 65 tilts he valve member 60 through 90° about its hinge axis 64 so that it is edge-on to the flow of fluid which is established through the connector 101. Thus, the impediment to the flow of fluid through the orifice 69*a* of the valve seat 69 as provided by the presence of the valve member is reduced to a minimum.

Figures 3A, 3B, 3C, 3D, 3E:
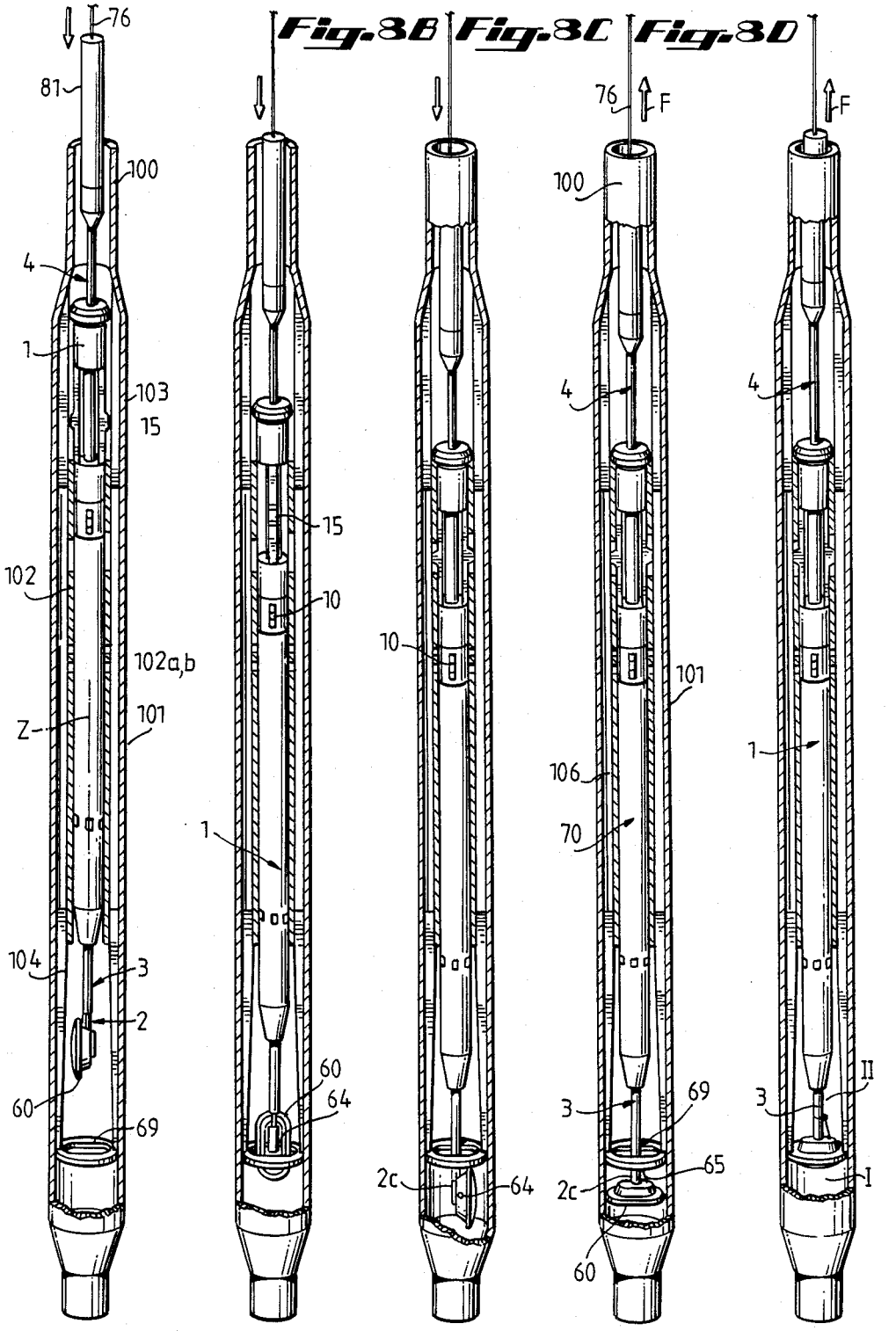
FIG. 3 is a larger scale and shows the region where the tool is locked in the connector sleeve which receives it, with the tool being omitted from the left-hand side of the figure.

By repeated release and traction operations on the cable 76, the valve 60 is alternately opened and closed. The number of opening/closing cycles is limited by the sleeve 5 which serves as an indexing member. The sleeve 5 is slidable between the element 1*b* of the part 1 and the element 4*c*of the part 4, and has an external thread 51 at its bottom end (see FIGS. 2*b* and 3) which is engaged in a complementary tapping 17 on the inside surface of said element 1*b*. The part 5 also includes pegs 52 in the vicinity of its thread 51, with the pegs being engaged in a guide path 13 comprising a set of grooves hollowed out in the periphery of the element 4*c* of the part 4 (see FIG. 7). Each groove 13*a*, 13*b*, . . . comprises a vertical branch m extending parallel to the axis Z of the tool, and a sloping branch n. These grooves follow one another in a head-to-tail disposition around the element 4*c*, with their vertical branches m alternately pointing upwardly and downwardly and with their sloping branches n all leading the same way around the axis Z of the part 2. All of the grooves run into each other with the ends of each sloping branch n opening out into the following vertical branch m.

The top of the sleeve 5 has a peripheral chamfer 53 enabling its top end to be inserted wedge-like between the element 1*b* of the part 1 and the bottom end of the locking members 10 which are provided with a corresponding chamfer 10*c* whenever the sleeve 5 moves upwardly. This causes the locking members to move towards the axis Z, i.e. to be retracted into an unlocking position inside the element 1*b*.

Figure 7:
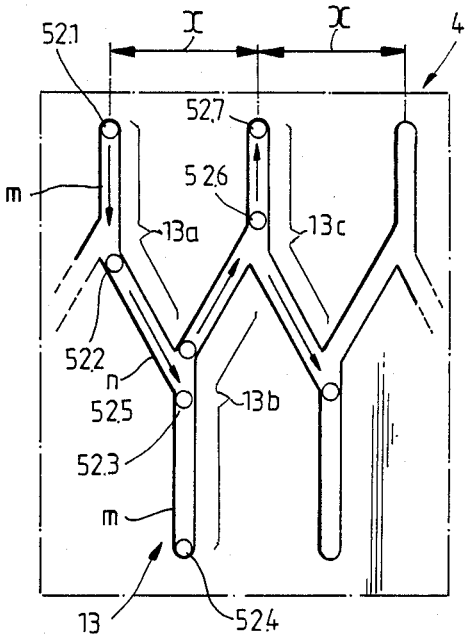
FIG. 7 is a diagrammatic developed view of the inside face of the tool envelope, showing the operation of the indexing member which enables the tool to be removed after a predetermined number of operations of its valve.

When the valve is open, the part 4 is in its bottom position and each peg 52 on the sleeve 5 is located at 52-1 at the top of one of the vertical branches m of one of the grooves 13*a*, 13*c*, . . . having upwardly directed vertical branches m (see FIG. 7). While the valve is being closed by applying traction to the cable 76, the part 4 moves upwardly and the peg in question encounters the sloping branch n of said groove 13*a* at point 52-2 where it is deflected into said sloping branch. After it has moved along the sloping branch, it enters the downwardly directed vertical branch m of the following groove 13*b* at point 52-3, and reaches the bottom end thereof 52-4 when the rising movement of the part 4 comes to an end and the valve member 60 has reached its closure position. When the valve is subsequently re-opened, the cable 76 is released, thereby causing the part 4 to move downwardly. The peg 52 runs back along the vertical branch m of the groove 13*b* and is then deflected to the sloping branch n thereof at 52-5, and finally reaches the upwardly directed vertical branch m of the groove 13*c* at 52-6, and after running along said vertical branch it comes to rest at the top 52-7 thereof when the part 4 reaches the bottom of its stroke. This position 52-7 is angularly offset from the starting position 52-1 by an amount x.

Thus, each operating cycles applied to the valve 60 causes the part 5 to rotate through a fraction x of a turn about the axis Z and relative to the part 4, which is caused to move up and down but which is prevented from rotating relative to the stationary part 1 by virtue of the peg 14 therein being engaged in the rectilinear groove 41 in the part 4. As a result, the part 5 which is coupled to the part 1 by complementary threaded portions 51 and 17 rises bit-by-bit each time it rotates through angle x. Once it has risen far enough, its chamfered top end 53 engages between the part 1 and the bottom end of the locking members 10, thereby extracting the bolts 10*b* from the groove 102*b* in the sleeve 102 where they were previously engaged, and thus unlocking the part 1. The tool 70 is thus released and may be raised to the surface.

In this final stage of operations, the studs 15 on the part 1 follow the paths 105 in the sleeve 102 in the reverse direction, thereby rotating the valve member 60 through 90° about the axis Z (zone Z3), which valve member has already been tilted by the spring 19 into a longitudinal position parallel to the axis Z, and then held in said orientation (zone Z2) in order to allow it to pass back through its seat without hindering the upward movement of the tool.

In addition to a sealing ring 66 between the valve member 60 and its seat 69, the tool includes several other sealing rings: there is a sealing ring 67 between a bottom end knuckle joint centered on the axis 64 of the bottom element 2c of the part 2 and a cavity of complementary shape provided in the valve member 60; there is a pair of sealing rings 25 between the skirt of the bottom element 4d of the part 4 and the top element 2a of the part 2 situated on either side of the transverse orifices 2a'; there is a sealing ring 26 between the top of the part 2 and the tube 4e of the part 4; there is a pair of sealing rings 44 between the elements 4d and 4c of the part 4 together with a sealing ring 91 between the elements 4a and 4b, and a sealing ring 92 between the elements 4b and 4c of said part 4; there is a sealing ring 93 between the elements 2a and 2b of the part 2; and there is a scraper ring 18 between the top of the part 1 and the element 4b of the part 4.

I claim:

1. A tool for closing a production column in a well containing fluid under pressure and designed to be lowered on the end of a suspension cable and to be temporarily fixed coaxially inside a sleeve of a tool connector incorporated in the production column, said connector being of greater diameter than the remainder of said column, said tool including the improvement of a valve member for co-operating with a corresponding valve seat fixed across the inside of said connector in order to close or to open the fluid-passing orifice therethrough; said orifice and said valve member being oblong in outline with the valve member being narrower than the width of said orifice; the valve member being orientable and capable of being positioned in a first orientation in which it extends longitudinally with the long axis of its outline being substantially parallel to the longitudinal axis of the tool thereby enabling the valve member to pass through said orifice, and along a second orientation where it extends transversely to the longitudinal axis of the tool thereby enabling it to co-operate with said valve seat after passing therethrough for closing said production column.

2. A tool according to claim 1, comprising a generally cylindrical first part having an outside diameter which is less than the inside diameter of the connector sleeve and which is capable of being locked coaxially therein, and a second part capable of sliding coaxially inside the first part and which includes a rod which emerges therefrom at the end where the valve member is mounted so as to be able to tilt about a hinge axis extending perpendicularly to the longitudinal axis of the rod, i.e. of the tool, and parallel to the short axis of the outline of the valve member.

3. A tool according to claim 2, wherein a third part is mounted to slide coaxially between the first part and the second part, said third part being in the form of a sleeve, and wherein a link extending in a plane passing through the general axis of the tool and perpendicular to the valve member hinge axis is hinged at one end to the valve member and at its other end to said third part in the region of the end thereof which projects from the first part so that when the second part slides out from the first part, the third part which is initially held in abutment against a shoulder on the second part accompanies the second part, thereby causing the link to place the valve member transversely in its second orientation, with the third part then being stopped by abutment means while the second part continues to move down without the third part, thus causing the link to tilt the valve member into its first orientation.

4. A tool according to claim 3, wherein the third part is urged to abut against said shoulder of the second part by a spring.

5. A tool according to claim 2, wherein the second part is constrained to rotate about the axis of the tool together with the first part, and wherein guide means are provided in the first part and on the connector sleeve such that when the tool reaches the connector as it moves down the production column, the first part is initially caused to pivot about the axis of the tool to take up an orientation in which the valve member hinge axis is parallel to the long axis of the orifice through the valve seat, with the first part being held in this orientation as the tool continues to descend over a distance which is greater than the length of the valve member, and finally to cause the first part to rotate through 90° about the tool axis so as to cause the valve member hinge axis to extend perpendicularly to the long axis of the orifice through the valve seat.

6. A tool according to claim 5, wherein the guide means provided between the first part and the connector sleeve comprise a pair of tracks and a pair of studs, said studs engaging in said tracks as the tool moves downwardly through the connector sleeve, with each track comprising in succession: a flared first zone capable of receiving one of said studs regardless of the orientation of the tool on its arrival in the connector sleeve; a narrow rectilinear second zone extending parallel to the axis of the tool; and a similarly narrow third zone extending through 90° around said axis.

7. A tool according to claim 6, wherein the guide paths are hollowed out in the inside surface of the connector sleeve and the studs are mounted on diametrically opposite points of the first part.

8. A tool according to claim 2, wherein the second part is coupled to a fourth part which is capable of sliding longitudinally inside the first part and which emerges therefrom at the opposite end from the second part, i.e. the end where the suspension cable is directly or indirectly attached to the tool, such that when a traction force is applied to said cable, the fourth part moves against the force of a return spring, thereby retracting the second part into the first part and at the same time applying the valve member against its seat in a closure position.

9. A tool according to claim 1, including a path for temporarily putting the portions of the production column which are situated on either side of the valve member into communication with each other prior to each occasion on which the valve member is opened.

10. A tool according to claim 1, including a path for temporarily putting the portions of the production column which are situated on either side of the valve member into communication with each other prior to each occasion on which the valve member is opened, said path being constituted by at least one first radial orifice through the wall of the first part, a second radial orifice through the wall of the second part which faces the first orifice when the valve member is in its closure position against its seat, said second orifice opening out into an axial channel running along the second part which in turn opens out through the valve member when the valve member is in its closure position via a third orifice through the center of the valve member, and a fourth orifice extending radially through the wall of the fourth part which is coupled to the second part with a degree of axial play; the position of said fourth orifice on the fourth part being such that it comes into alignment with the first and second orifices during un-loaded displacement corresponding to said play as performed by the fourth part when the fourth part is displaced towards the second part while the valve is closed for causing the valve to open.

11. A tool according to claim 10, wherein the axial channel through the second part extends to the opposite end of the tool from the valve via an axial channel through the fourth part, said two axial channels communicating with each other via a sealed sliding junction.

12. A tool according to claim 2, wherein the first part is provided with at least one locking member subjected to the action of at least one spring urging the locking member to emerge radially through the wall of the first part in order to be engaged in a peripheral recess provided in the inside surface of the connector sleeve.

13. A tool according to claim 12, wherein the or each locking member comprises a bolt for engaging in a peripheral groove which constitutes said recess, and wherein the complementary top edges of the bolt and the groove directed towards the connection to the suspension cable are slightly undercut.

* * * * *